United States Patent [19]

Roden

[11] 4,062,557

[45] Dec. 13, 1977

[54] EIGHT WHEEL SKATEBOARD

[76] Inventor: Harry F. Roden, 3863 Motor Ave., Culver City, Calif. 90230

[21] Appl. No.: 715,877

[22] Filed: Aug. 19, 1976

[51] Int. Cl.[2] ..... A63C 17/00

[52] U.S. Cl. ..... 280/87.04 A; 280/11.27

[58] Field of Search ..... 280/87.04 A, 87.04 R, 280/11.1 BT, 11.28, 11.27, 11.19

[56] References Cited

U.S. PATENT DOCUMENTS

| | | | |
|---|---|---|---|
| 1,247,801 | 11/1917 | Egge | 280/87.04 A |
| 2,581,809 | 1/1952 | Murray | 280/11.28 |

*Primary Examiner*—Joseph F. Peters, Jr.
*Assistant Examiner*—John A. Pekar
*Attorney, Agent, or Firm*—Ralph B. Pastoriza

[57] ABSTRACT

A skateboard has front and rear trucks each supporting four wheels centrally pivoted to the axle on the undercarriages of the skateboard normally provided for the conventional type front and rear wheels. Each truck can rock about its central pivot on the axis and thereby reduce the amplitude of small bumps experienced by the board successively passed over by the leading and trailing wheels of each truck.

3 Claims, 3 Drawing Figures

EIGHT WHEEL SKATEBOARD

This invention relates to skateboards and more particularly to a skateboard having four wheel front and rear trucks to improve its operation.

BACKGROUND OF THE INVENTION

Conventional skateboards include a foot board having front and rear under carriages mounted thereon supporting front and rear axles. Two front wheels are mounted on opposite ends of the front axle respectively and two rear wheels are mounted on opposite ends of the rear axle respectively.

When the skateboard passes over small bumps or stones, its operation can become unstable, particularly if the amplitude or raising of the skateboard as a consequence of one or both wheels passing over the bump is large. As is known to those versed in the art, the under carriage mounting for the front and rear axles is such that tilting of the skateboard on one side or the other causes the wheels to toe inwardly in a direction to cause the skateboard to execute a turn in the direction of the tilt. In such a turn, one skateboard wheel is at a different level than the other relative to the underside surface of the board. It will thus be appreciated that should the skateboard pass over a small bump such that only one wheel engages the bump while on a straight line course, inadvertent turning of the skateboard can result.

Any means whereby the effective amplitude of bumps encountered by the skateboard can be decreased would thus constitute a great improvement in overall skateboard operation.

BRIEF DESCRIPTION OF THE PRESENT INVENTION

The present invention contemplates the provision of a new wheel arrangement for skateboards adaptable to the presently available under carriage structures normally supporting the front and rear wheel axles.

In accord with the present invention, rather than front and rear pairs of wheels, there are substituted onto the front and rear axles, front and rear trucks. Each truck is in the form of a rectangular frame having four wheels mounted adjacent to its four corners. Intermediate points on the longitudinal sides of the rectangular frames are pivotally mounted on the front and rear axles so that each of the trucks can rock about these axles.

The provision of the trucks resulting in an eight wheel skateboard effectively cuts the amplitude of bumps and the like over which the wheels successively pass approximately in one half. On the other hand, since the entire truck structure is mounted as a substitute for the normal wheels, the truck structure with its four wheels will toe in for proper turning control of the skateboard when the board surface itself is tilted so that the skateboard of the present invention can be maneuvered in substantially the same manner as a normal skateboard.

BRIEF DESCRIPTION OF THE DRAWINGS

A better understanding of this invention will be had by referring to the accompanying drawings in which.

DETAILED DESCRIPTION OF THE INVENTION

Figure 1:
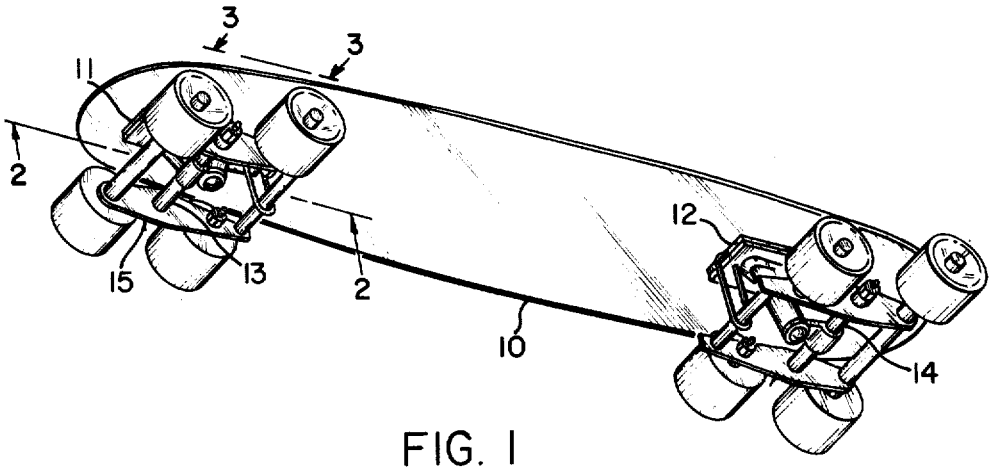
FIG. 1 is a perspective, underside view of the improved skateboard of this invention.

Referring first to FIG. 1, there is shown a skateboard 10 which may be a conventional shape provided with the usual front and rear undercarriage structures 11 and 12 supporting front and rear axles 13 and 14.

In accord with the present invention, rather than mounting the conventional skateboard wheels on opposite ends of the axles 13 and 14, front and rear trucks 15 and 16 are substituted therefor. Each of the trucks 15 and 16 is identical in construction and therefore a detailed description of one will suffice for both.

Figure 2:
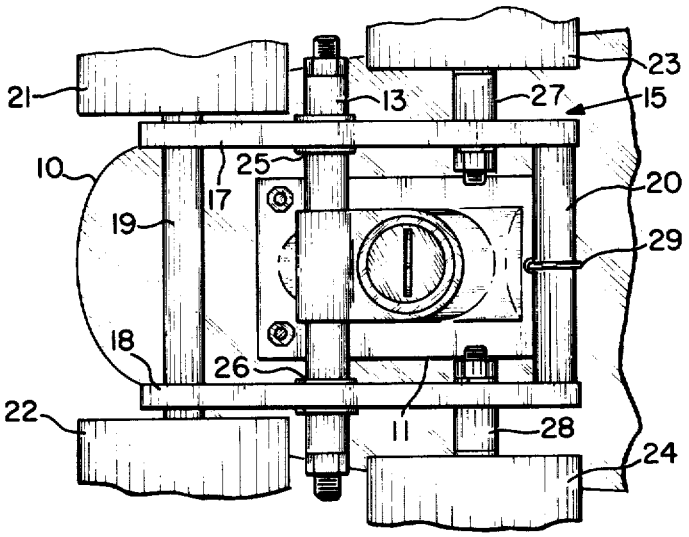
FIG. 2 is a fragmentary bottom plan view looking in the direction of the arrows 2—2 of FIG. 1 illustrating the front truck and carriage of the skateboard; and, FIG. 3 is a fragmentary side elevational view partly broken away taken in the direction of the arrows 3—3 of FIG. 1.

Referring to the truck 15 as illustrated in FIG. 2, this truck is in the form of a rectangular frame made up of longitudinal sides 17 and 18 and outer and inner transverse sides 19 and 20. By outer side is meant that side closest to an end of the skateboard and by inner side is meant that side closest to the inner or center portion of the skateboard. Four wheels 21, 22, 23, and 24 are respectively mounted at the four corners of the rectangular frame making up the truck 15.

As will be evident from FIG. 2, the front axle 13 pivotally mounts the truck at intermediate points 25 and 26 on the longitudinal sides 17 and 18 so that the truck can execute rocking movements about this axle.

In the particular embodiment illustrated, the trailing wheels 23 and 24 are wider apart than the leading wheels 21 and 22, this effect being accomplished by the provision of small spacing collars 27 and 28 between the trailing wheels and the longitudinal side portions of the frame to which they are rotatably mounted. Increasing the spacing between the trailing wheels for each of the trucks increases the transverse stabilization but such increased spacing is not an essential feature of this invention.

Still referring to FIG. 2, a stop means is provided as indicated at 29 secured to the undercarriage structure 11 and passing over the inner transverse side 20 to limit the rocking movement of the truck to a given degree.

Figure 3:
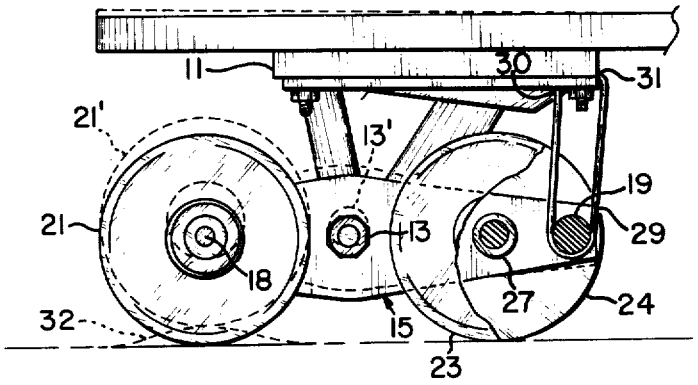

The foregoing stop arrangement can be better understood by reference to the side elevational view of FIG. 3 wherein the trailing wheel 23 has been broken away to expose the stop means 29. Essentially, this stop means takes the form of a hairpin shaped wire having the ends of its arms 30 and 31 secured to the undercarriage 11 and its loop portion receiving the inner transverse side 19 of the rectangular shaped frame making up the truck. Essentially, the limit of rocking movement is determined by the length of this hairpin shaped wire. The main purpose for the stop means 29 is to permit the skateboard to be tilted up on its rear truck in such a manner that only the two trailing wheels of the rear truck engage the ground. In this respect, reference is had to the rear truck 16 of FIG. 1 wherein it will be noted that the hairpin shaped wire limits the rocking movement of this particular truck in a counterclockwise direction so that the trailing rear wheels which are wider apart will only engage the ground when a skater is performing what is known in the art as "wheelies".

Referring back to FIG. 3, there is indicated by the dashed lines 32 a hump or bump in the surface upon which the skateboard is riding which, when engaged by the front wheels such as the wheel 21, will cause a rocking movement of the truck 15 about the axle 13.

Because of the central pivoting of the rectangular frame intermediate the leading and trailing wheels, the board itself will only be raised to approximately one half the amplitude of the hump 32 as it successively passes beneath the leading and trailing wheels 21 and 23. Thus, as indicated by the dashed lines in FIG. 3 as at 21' and 13', the moved positions of the wheel and axle are illustrated respectively as a consequence of the bump 32 wherein it will be appreciated that the axle and thus the front portion of the skateboard itself is only raised to approximately half the distance of the wheel 21.

Since the same axle 13 which is provided for normal wheels is untilized to pivotally mount the truck intermediate the leading and trailing wheels on the truck, the truck will execute toeing in movements in response to tilting of the skateboard by a shifting of the user's weight as is the case with the conventional single wheels on each end of the axle 13 so that the skateboard can maneuver in the same manner as a conventional skateboard and yet provide the desired advantage of greatly cushioning bumps and the like.

From the foregoing description, it will thus be evident that the present invention has provided an improved skateboard by the provision of eight wheels, four such wheels being mounted on a front truck and four such wheels being mounted on a rear truck, all as described.

What is claimed is:

1. An eight-wheel skateboard having front and rear under carriage structures supporting front and rear axles; and front and rear wheel trucks, each of said wheel trucks comprising a rectangular frame including longitudinal and transverse sides, and having four wheels rotatably mounted adjacent to its four corners, respectively, an intermediate point of each of the longitudinal sides of said rectangular frame being pivoted to the axle of an associated under carriage for rocking movement; and, stop means secured to the front and rear under carriage structures and passing over the innermost transverse sides of the rectangular frames to limit the rocking movement of the trucks to a given degree.

2. A skateboard according to claim 1, in which each stop means comprises a hair-pin shaped wire having the ends of its arms secured to an associated under carriage and its loop portion receiving the innermost transverse side of the rectangular frame associated with said carriage, the length of the hair-pin shaped wire defining the given degree of rocking movement.

3. A skateboard according to claim 1, in which the trailing wheels on each truck are mounted further apart than the leading wheels to increase the stability of the skateboard in a transverse direction.

* * * * *